US008887391B2

(12) United States Patent
Barnat

(10) Patent No.: US 8,887,391 B2
(45) Date of Patent: Nov. 18, 2014

(54) TURBINE DISK SLOT BOTTOM MACHINING

(75) Inventor: Krzyszlof Barnat, Berlin, CT (US)

(73) Assignee: United Technologies Corporation, Hartford, CT (US)

( * ) Notice: Subject to any disclaimer, the term of this patent is extended or adjusted under 35 U.S.C. 154(b) by 919 days.

(21) Appl. No.: 12/692,863

(22) Filed: Jan. 25, 2010

(65) Prior Publication Data

US 2011/0179646 A1 Jul. 28, 2011

(51) Int. Cl.
*B23B 27/16* (2006.01)
*B24B 19/00* (2006.01)

(52) U.S. Cl.
CPC ..... *B24B 19/009* (2013.01)
USPC ..... 29/889.21; 29/889.2; 29/558

(58) Field of Classification Search
CPC ..... B23P 13/04; B23P 15/006; B23P 13/02; B23C 3/30; B23C 2210/0421–2210/0435; B23C 2215/52; B23C 2220/04; B23C 2220/36; B23C 2220/366; B24B 1/00
USPC ..... 29/889, 889.21, 889.2, 889.22, 557, 29/558; 451/47, 48, 57, 58

See application file for complete search history.

(56) References Cited

U.S. PATENT DOCUMENTS

| | | | | |
|---|---|---|---|---|
| 5,430,936 | A | 7/1995 | Yazdzik, Jr. et al. | |
| 5,484,327 | A * | 1/1996 | Kovach | 451/49 |
| 5,593,282 | A | 1/1997 | Krueger | |
| 5,676,505 | A | 10/1997 | Gauss et al. | |
| 5,931,616 | A | 8/1999 | Daub | |
| 6,244,822 | B1 | 6/2001 | Sinclair et al. | |
| 6,302,651 | B1 | 10/2001 | Kildea et al. | |
| 6,767,168 | B2 | 7/2004 | Miller | |
| 6,883,234 | B2 | 4/2005 | Packman et al. | |
| 7,007,382 | B2 | 3/2006 | Mantel | |
| 7,008,146 | B2 * | 3/2006 | DeRoche et al. | 407/42 |
| 7,303,461 | B1 | 12/2007 | Campomanes et al. | |
| 2009/0148296 | A1 | 6/2009 | Barnat et al. | |

* cited by examiner

*Primary Examiner* — Christopher Besler
(74) *Attorney, Agent, or Firm* — Carlson, Gaskey & Olds, P.C.

(57) ABSTRACT

A method for forming a slot in a rotor disk includes a finishing step using a tool rotating at angle off normal in direction opposite a direction that the tool is driven through the slot. A finish profile is obtained in part by removing material from a bottom surface with a tool rotating about an axis off normal.

17 Claims, 5 Drawing Sheets

TURBINE DISK SLOT BOTTOM MACHINING

BACKGROUND

This disclosure generally relates to a method of forming a slot in a rotor disk for a turbine.

A turbine disk for a gas turbine engine includes a plurality of specially shaped slots within which a correspondingly shaped root section of an airfoil is secured. The slots typically include a greater width further within the slot such that an undercut is required at one or several locations within the slot. Form tools that are utilized to form the desired shapes encounter large stresses due to the large material removal area. Form tools utilize cutting edges and grinding edges to provide the desired finished slot shape.

Designing and developing more efficient processes and methods of removing material and forming a slot within a turbine disk are desirable.

SUMMARY

A method for forming a slot in a rotor disk is disclosed that includes a finishing step using a tool rotating at angle off normal in a direction opposite a direction that the tool is driven through the slot.

The disclosed method includes the step of forming an initial slot from which subsequent intermediate slot profiles are formed. Each successive machining step removes additional material approaching the desired finished profile. The finish profile is obtained in part by removing material from a bottom surface with a tool rotating about an axis off normal. The tool is rotated about an axis that is tilted away from the direction in which the tool is driven through the slot. The tilt away from the axis pushes the tool through the slot to remove material to form the desired finished slot profile.

These and other features disclosed herein can be best understood from the following specification and drawings, the following of which is a brief description.

DETAILED DESCRIPTION

Figure 1:
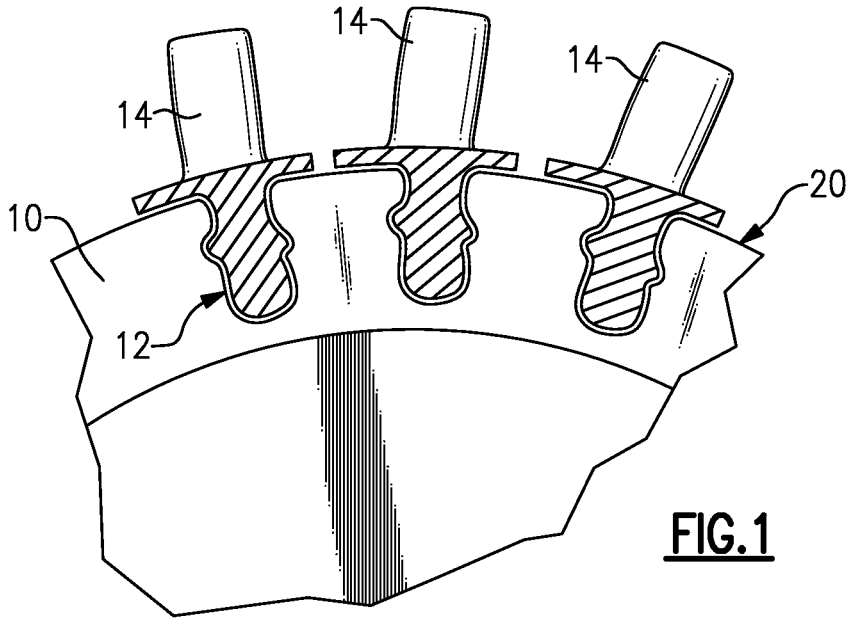
FIG. 1 is a schematic view of a rotor disk supporting a plurality of airfoils.

Referring FIG. 1, a rotor 10 includes a plurality of slots 12 that each have a specialized profile for securing a corresponding plurality of airfoils 14. Each of the airfoils 14 include a root section with a shape that corresponds with the profile of the slot 12. The example slots 12 extend through the rotor 10 and have a top opening on a periphery 20 of the rotor 10. The slots 12 are formed through a machining process that utilizes different form tools to machine the slot 12 from a rough profile through to the finished profile that corresponds with the root of the airfoils 14.

Figure 2:
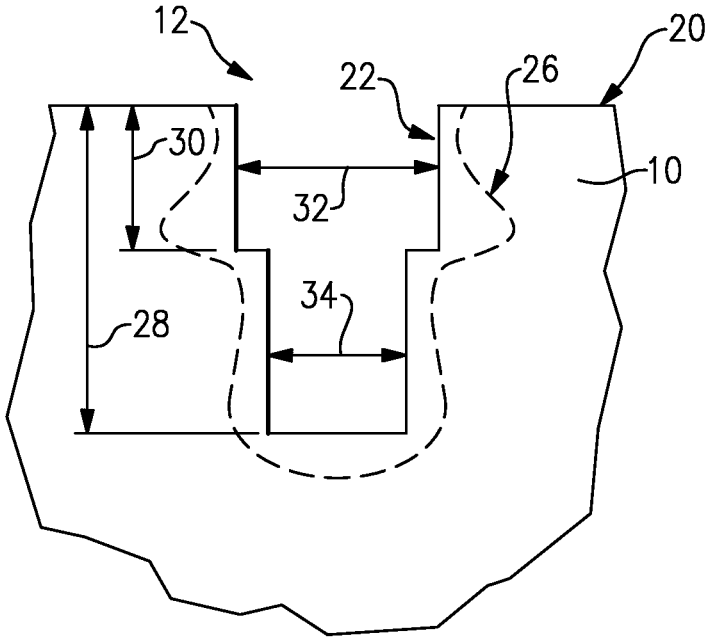
FIG. 2 is a schematic view of an example slot in an initial form.

Referring to FIG. 2, an example slot 12 is shown with a rough initial profile 22. The initial profile is substantially rectangular and includes an initial overall depth 28 with a width 34. The slot 12 is stepped in the initial form and includes a larger width 32 with a depth 30 that is less than the overall depth 28. The initial shape 22 provides a starting point for machining of the slot 12 to a final desired profile indicated by dotted lines 26.

Figure 3:
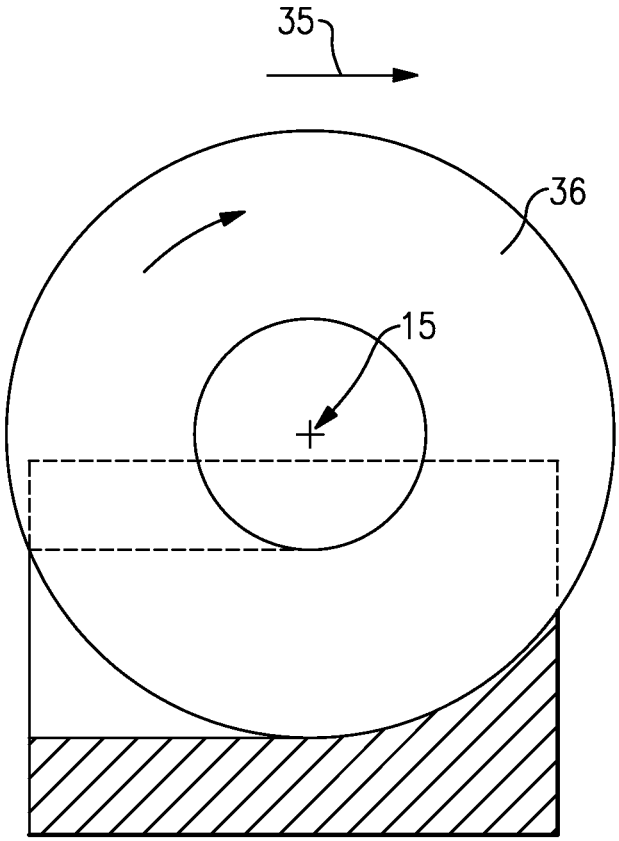
FIG. 3 is a schematic view of an example machining step for forming the slot in the initial form.

Referring to FIG. 3, the initial profile 22 is formed by a rotary tool 36. The example rotary tool 36 rotates about an axis 15 and is driven through the rotor 10 in a direction 35. The rotary tool 36 can include a cutting edge for removing material from the rotor 10. The rotary tool 36 may also comprise a grinding wheel that removes material from the rotor 10 to form the desired initial slot profile 22.

As appreciated, the initial slot profile 22 is configured with respect to the desired final profile 26 to provide a starting slot that can be further machined by subsequent tools to efficiently produce a completed slot 12 of a desired shape and finish. Other configurations of slots 12 can be formed utilizing the methods of this disclosure.

Figure 4:
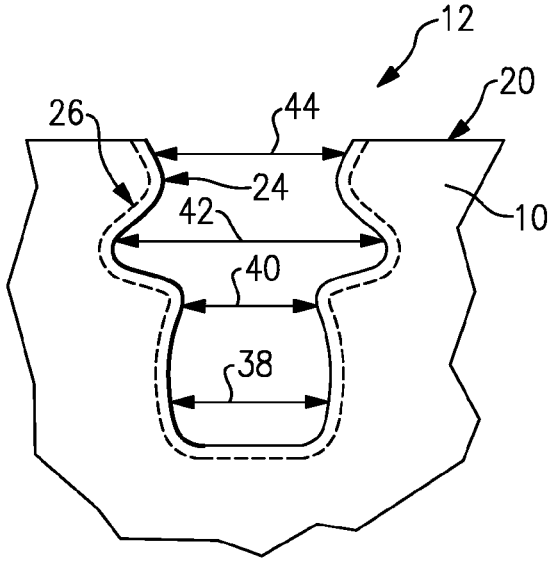
FIG. 4 is a schematic view of the example slot in an intermediate form.
Figure 5:
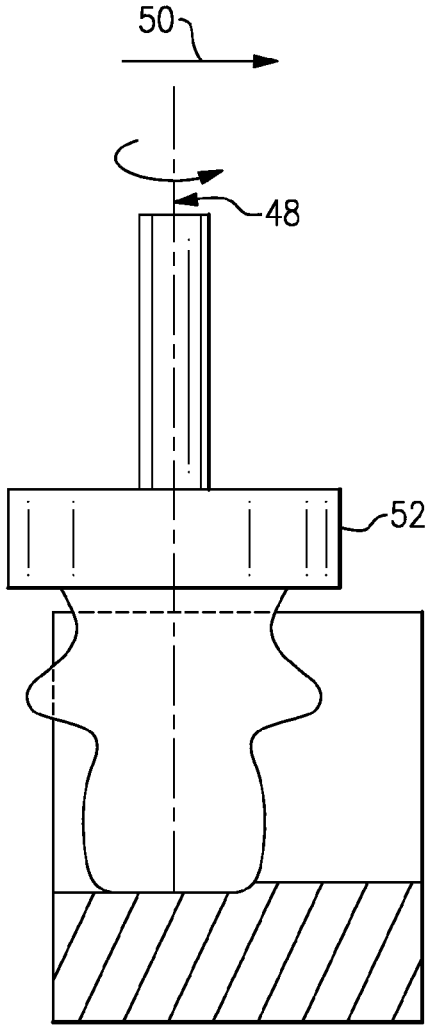
FIG. 5 is a schematic view of a cutting tool for forming the slot in the intermediate form.

Referring to FIGS. 4 and 5, an intermediate profile 24 is formed utilizing a tool 52 rotating about the axis 48 and driven in a direction 50 through the slot 12. The intermediate slot profile 24 removes material to generate a bottom width 38 that is wider that a width 40 that is above the bottom width 38. A middle width 42 is disposed above the smaller width 40 and a top width 44 defines the opening of the slot 12 at the rotor periphery 20.

The intermediate profile 24 transforms the rectangular initial profile 22 into a slot 12 having contours that are closer to the desired final configuration. The tool 52 rotates about the axis 48 and is driven substantially vertically through the slot 12. The example tool 52 can be an end mill that includes shaped cutting edges that remove material from the slot to form the desired intermediate profile 24. The tool 52 may also comprise a grinding tool that includes a contoured surface with an abrasive surface for removing material to form the intermediate profile 24. The intermediate profile 24 is provided by removing material to substantially the desired completed internal shape, while leaving sufficient material for the finish machining process.

Figure 6:
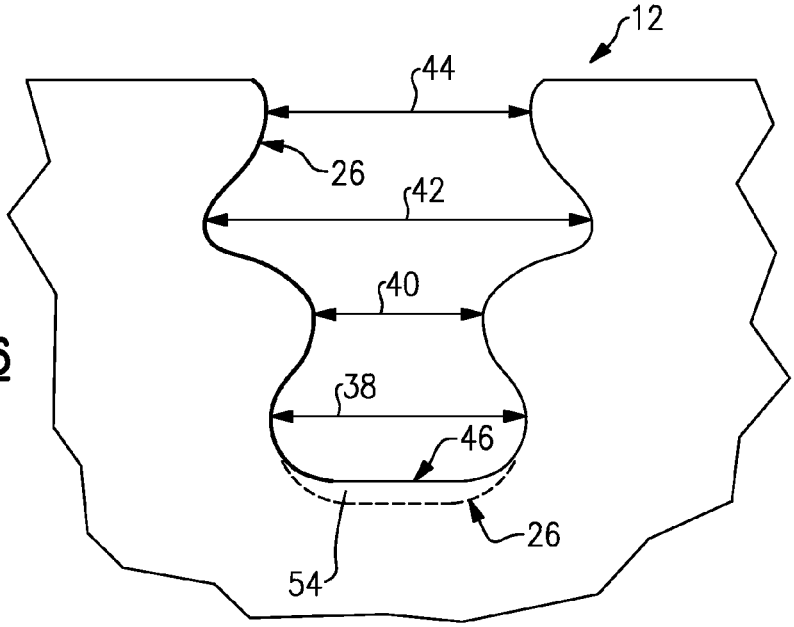
FIG. 6 is a schematic view of the example slot in a partially-finished form.
Figure 7:
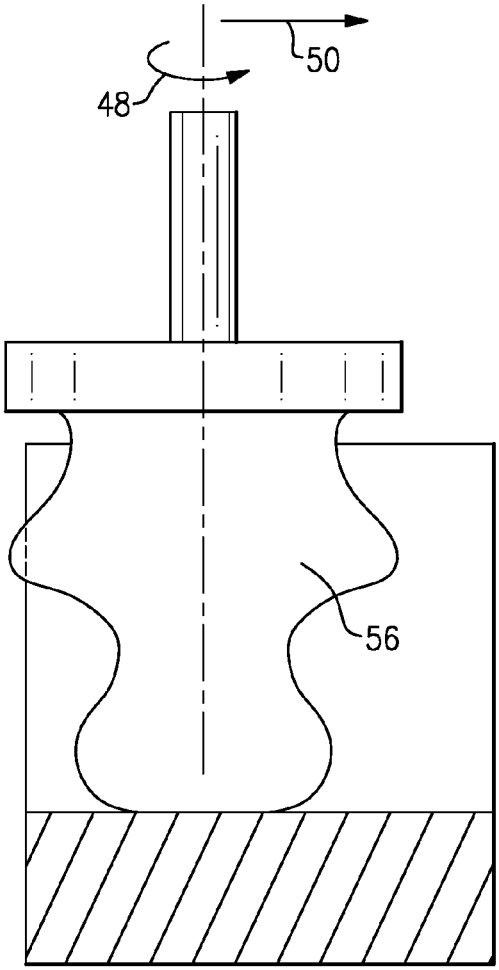
FIG. 7 is a schematic view of a cutting tool for forming the slot in the partially-finished form.

Referring to FIGS. 6 and 7, a partially-finishing step is schematically shown that provides much of the finished profile 26, although not the bottom surface 46. The tool 56 removes material on first portions of the profile to provide the desired finished profile 26 on much of the interior contour. The desired width 38, 40, 42 and 44 are provided to nearly complete the desired finished profile 26. However, material 54 is left at the bottom surface for another machining step. As appreciated, stresses encountered by machining both sides and the bottom surface can cause undesirable shortening of tool life. Accordingly, the finish profile 26 is formed utilizing two finish machining processes. In this way, each of the finish tools can provide good results on part of the slot interior surface while improving tool life.

Figure 8:
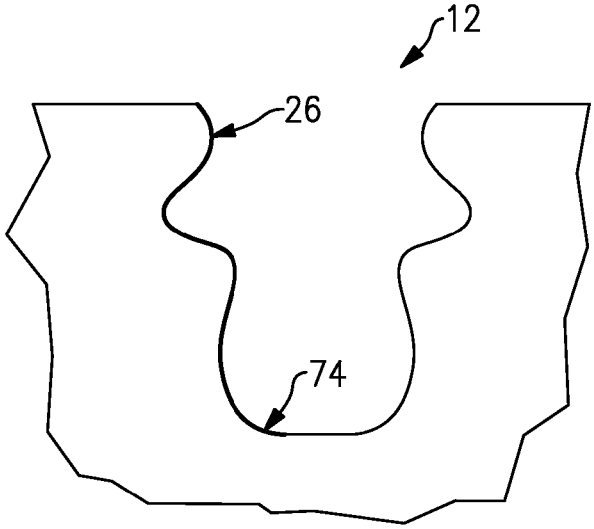
FIG. 8 is a schematic view of the example slot in a finished form.
Figure 9:
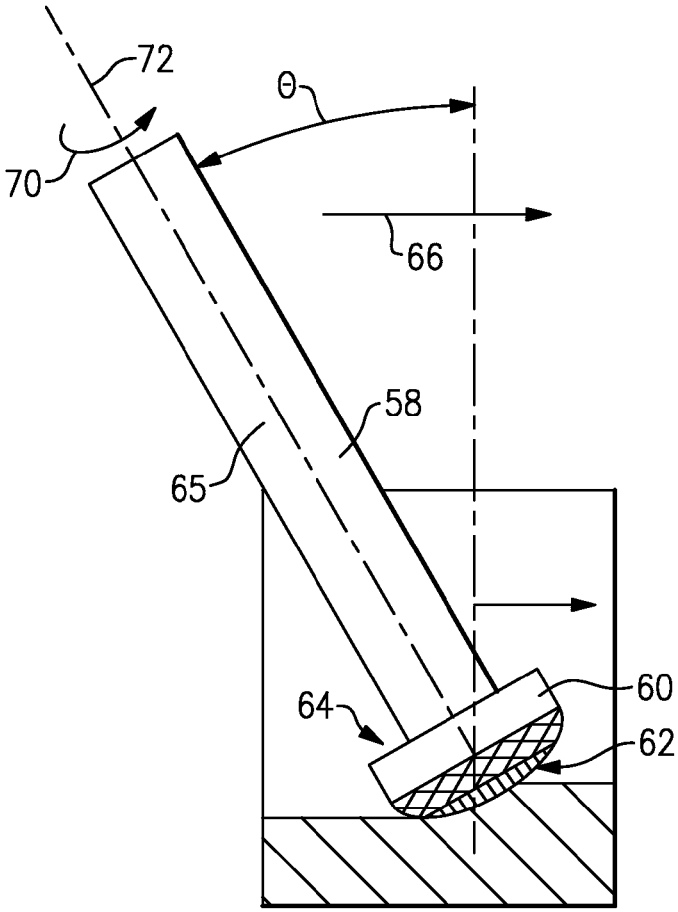
FIG. 9 is a schematic view of an example grinding tool machining the slot to the finished form.

Referring to FIGS. 8 and 9, the final profile 26 is formed by a grinding tool 58 that removes the material 54 from the bottom of the slot 12. The material removal provided by the grinding tool 58 completes the forming process to provide the finish profile 26.

The example finish grinding step is conducted with the grinding tool 58 that includes a grinding bit 60 supported at the end of shaft 65. The grinding bit 60 comprise an abrading material that either forms the entire bit 60, or includes a substrate that supports an abrading coating that removes material form within the slot 12. The grinding bit 60 includes a bottom surface 62 and a top surface 64.

The grinding process for removing material and finishing the bottom of the slot 12 is accomplished by rotating the grinding tool 58 about an axis 72 in a direction 70 that is tilted away from an orientation normal to the direction in which the grinding tool 58 is driven through the slot 12 as is indicated by arrow 66. The axis 72 is tilted opposite the direction 66 in which the grinding tool 58 is driven to push the grinding bit 60 through the slot 12. The angle θ at which the grinding tool 58 and thereby the axis of rotation falls within a range greater than 0° and less then 90° degrees. In the disclosed example, the grinding tool 58 is tilted at an angle between 5° and 50° degrees from normal. Further, the grinding tool 58 can be operated at an angle between 10° and 30° from normal to the direction of movement of the tool 58.

The bottom surface 62 therefore leads the grinding tool 58 through the slot 12 to remove material along the bottom surface 74 of the slot 12. Leading with the bottom surface 62 provides additional clearance of the remainder of the grinding tool 58 such that the working material removal part of the grinding bit 60 can extend into the slot 12 a distance greater than if the tool rotated about an axis normal to the direction of movement 66.

Figure 10:
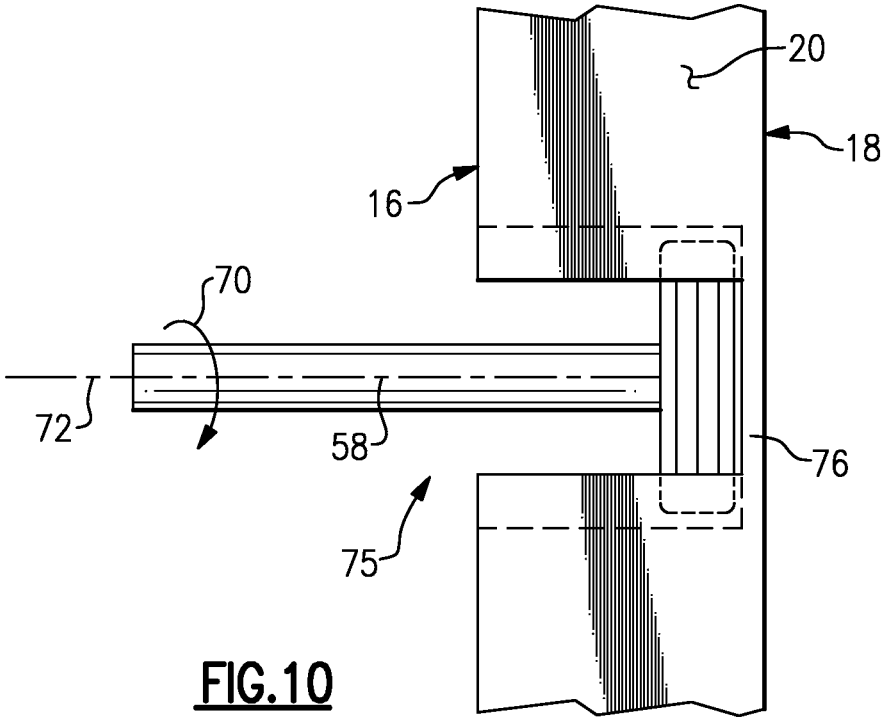
FIG. 10 is a schematic view of another slot and forming process.

Referring to FIG. 10, another example slot 75 does not extend entirely through the rotor periphery 20. The example slot 75 extends from a first side 16 of the slot toward a second side 18, but does not extend completely through the rotor 10. The grinding tool 58 can extends under the lip 76 to machine portions of the slot 75 that would otherwise not be accessible by a tool rotating about an axis normal to the driving direction.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A method of forming a slot within a rotor disk comprising the steps of:

forming an initial slot profile of a slot with a first tool;

removing material from the initial slot profile to generate a partially-finished slot profile; and removing material from the partially-finished slot profile with a grinding tool to generate a finished slot profile, wherein the grinding tool includes a grinding bit supported at an end of a shaft, the grinding tool rotating about an axis and the grinding tool tilted away from a line normal to a bottom surface of the partially-finished slot profile in a direction opposite to a direction of movement of the grinding tool such that the grinding bit is forward of the shaft in the direction of movement of the grinding tool.

2. The method as recited in claim 1, wherein the grinding tool is driven in a first direction through the slot and the grinding tool is tilted in a second direction opposite the first direction such that the grinding tool is pushed forward through the slot.

3. The method as recited in claim 1, wherein the grinding tool includes a bottom surface and a top surface, and the bottom surface is moved forward through the slot to remove material.

4. The method as recited in claim 1, including the step of removing material from the initial slot profile to generate an intermediate slot form prior to removing material to form a partially-finished slot profile.

5. The method as recited in claim 4, including removing material from the intermediate slot form to provide the partially-finished slot profile, wherein a bottom surface of the slot is not machined to obtain the partially-finished slot profile.

6. The method as recited in claim 5, wherein the grinding tool removes material from the bottom surface of the slot to complete the finished slot profile.

7. The method as recited in claim 1, wherein the axis in which the grinding tool rotates is tilted away from normal within a range of between 5° and 30° degrees in a direction opposite the direction of movement of the grinding tool through the slot.

8. The method as recited in claim 1, wherein the grinding bit comprises a bottom portion in material removal contact with the bottom of the slot and a top surface not in contact with the slot.

9. A method of forming a blade attachment slot comprising the steps of:

removing material from a rotor to form an initial slot profile;

removing material from the initial slot profile to form a partially-finished profile, wherein the partially-finished profile comprises a finished portion and a non-finished portion; and removing material from the non-finished portion of the partially-finished profile with a grinding tool that includes a grinding bit supported at an end of a shaft, the grinding tool rotating about an axis and disposed at an angle relative to a line normal to a bottom surface of the partially-finished profile in a direction opposite a direction in which the grinding tool is moved through the slot such that the grinding bit is forward of the shaft in the direction in, which the grinding tool is moved.

10. The method as recited in claim 9, wherein the grinding tool includes a grinding bit with a top surface and a bottom surface, a portion of the bottom surface in contact with the non-finished portion of the partially-finished profile for removing material to form the finished slot profile.

11. A method of forming a blade attachment slot comprising the steps of:

removing material from a rotor to form an initial slot profile;

removing material from the initial slot profile to form a partially-finished profile, wherein the partially-finished profile comprises a finished portion and a non-finished portion; and removing material from the non-finished portion of the partially-finished profile with a grinding tool rotating about an axis and the grinding tool disposed at an angle relative to a line normal to a bottom surface of the partially-finished profile in a direction opposite a direction in which the grinding tool is moved through the slot, wherein the angle relative to normal is greater than 5° and less than 50°.

12. The method as recited in claim 9, wherein the axis in which the angle relative to normal is between 5° and 30°.

13. The method as recited in claim 9, wherein in the rotor includes a first side and a second side spaced apart by a width of a peripheral surface and the slot does not open to both sides of the rotor.

14. A method of forming a slot through a rotor for a turbine disk comprising the steps of:

removing material from a rotor to form an initial slot profile;

removing material from the initial slot profile to form a partially-finished profile, wherein the partially-finished profile includes a finished portion and a non-finished portion; and removing material from the partially-finished profile with a tool rotating about an axis, wherein the tool includes a material removal surface and a shaft, the tool disposed at an angle relative to a line normal to a bottom surface of the partially-finished profile opposite a direction in which the tool is moved through the slot, wherein the material is removed by pushing the material removal surface supported at an end of the shaft through the slot from a first side of the rotor through to a second side of the rotor such that the material removal surface is forward of the shaft in the direction in which to tool is moved.

15. A method of forming a slot through a rotor for a turbine disk comprising the steps of:

removing material form a rotor to form an initial slot profile;

removing material from the initial slot profile to form a partially-finished profile, wherein the partially-finished profile includes a finished portion and a non-finished portion; and removing material from the partially-finished profile with a tool rotating about an axis, the tool disposed at angle relative to a line normal to a bottom surface of the partially-finished profile opposite a direction in which the tool is moved through the slot, wherein the angle is between 5 and 50 degrees.

16. The method as recited in claim 14, wherein the angle from normal to and opposite the direction of tool movement is between 5 and 30 degrees.

17. The method as recited in claim 14, wherein the tool comprises a grinding tool including a grinding bit supported on the shaft.

* * * * *

UNITED STATES PATENT AND TRADEMARK OFFICE

CERTIFICATE OF CORRECTION

PATENT NO. : 8,887,391 B2
APPLICATION NO. : 12/692863
DATED : November 18, 2014
INVENTOR(S) : Barnat It is certified that error appears in the above-identified patent and that said Letters Patent is hereby corrected as shown below:

ON THE TITLE PAGE item [75], should read:

--Krzysztof Barnat, CT (US)--

Signed and Sealed this
Thirtieth Day of June, 2015

Michelle K. Lee

Michelle K. Lee
*Director of the United States Patent and Trademark Office*